US008511059B2

(12) United States Patent
Poyyapakkam et al.

(10) Patent No.: US 8,511,059 B2
(45) Date of Patent: Aug. 20, 2013

(54) METHODS OF REDUCING EMISSIONS FOR A SEQUENTIAL COMBUSTION GAS TURBINE AND COMBUSTOR FOR A GAS TURBINE

(75) Inventors: Madhavan Narasimhan Poyyapakkam, Mellingen (CH); Adnan Eroglu, Untersiggenthal (CH); Richard Carroni, Niederrohrdorf (CH); Gregory John Kelsall, Broughton Astley (GB); Jian-Xin Chen, Lutterworth (GB)

(73) Assignee: ALSTOM Technology Ltd., Baden (CH)

( * ) Notice: Subject to any disclaimer, the term of this patent is extended or adjusted under 35 U.S.C. 154(b) by 755 days.

(21) Appl. No.: 12/241,211

(22) Filed: Sep. 30, 2008

(65) Prior Publication Data

US 2010/0077720 A1 Apr. 1, 2010

(51) Int. Cl.
*F02C 1/06* (2006.01)
*F02C 6/00* (2006.01)

(52) U.S. Cl.
USPC ..... 60/39.17; 60/796; 60/225; 60/733; 60/798; 60/800; 431/154; 431/159; 431/343

(58) Field of Classification Search
USPC ..... 60/39.55, 39.17, 733, 798, 800, 775, 60/737, 738; 431/154, 159, 343
See application file for complete search history.

(56) References Cited

U.S. PATENT DOCUMENTS

| | | | | |
|---|---|---|---|---|
| 6,089,024 | A * | 7/2000 | Hatanaka | 60/671 |
| 6,339,923 | B1 * | 1/2002 | Halila et al. | 60/798 |
| 6,978,622 | B2 * | 12/2005 | Dittmann et al. | 60/782 |
| 7,254,951 | B2 * | 8/2007 | Lockwood, Jr. | 60/774 |
| 2006/0005542 | A1 * | 1/2006 | Campbell et al. | 60/723 |
| 2007/0227155 | A1 * | 10/2007 | Nemet et al. | 60/772 |
| 2010/0077756 | A1 | 4/2010 | Poyyapakkam et al. | |
| 2010/0077757 | A1 | 4/2010 | Poyyapakkam et al. | |

* cited by examiner

*Primary Examiner* — Phutthiwat Wongwian
*Assistant Examiner* — Craig Kim
(74) *Attorney, Agent, or Firm* — Cermak Nakajima LLP; Adam J. Cermak

(57) ABSTRACT

In an SEV combustor and a method for reducing emissions in an SEV combustor of a sequential combustion gas turbine, an air/fuel mixture is combusted in a first burner and the hot gases are subsequently introduced into the SEV combustor (1) for further combustion. The SEV combustor (1) includes a chamber having a chamber wall (5) defining a mixing portion (8), for mixing the hot gases with a fuel, and a combustion region (9), at least one inlet (2) for introducing the hot gases into the mixing region (8), at least one inlet (12) for introducing a fuel into the mixing region (8) and at least one inlet (10, 13) for introducing steam into the mixing region.

16 Claims, 2 Drawing Sheets

METHODS OF REDUCING EMISSIONS FOR A SEQUENTIAL COMBUSTION GAS TURBINE AND COMBUSTOR FOR A GAS TURBINE

BACKGROUND

1. Field of Endeavor

The present invention relates to a method of reducing emissions and flashback in a sequential combustion gas turbine, and to a combustor for such a gas turbine.

2. Brief Description of the Related Art

A gas turbine with sequential combustion is known to be able to improve the efficiency and to reduce the emissions of a gas turbine. This can be achieved one way by increasing the turbine inlet temperature. In sequential combustion gas turbines, engine fuel is combusted in a first combustor and the hot combustion gases are passed through a first turbine and subsequently supplied to a second combustor, known as an SEV combustor, into which fuel is introduced through a lance projecting into the combustor. The combustion of the hot gases is completed in the SEV combustor and the combustion gases are subsequently supplied to a second turbine.

SEV combustors were originally designed for natural gas and oil operation. The prior art SEV combustor design poses challenges in terms of both durability and higher chances of auto ignition (premature ignition) or flash back occurrence when operated on syngas or fuels with high $H_2$ content. A flashback event is a premature and unwanted re-light of the premixing zone, which produces an order of magnitude increase in NOx emissions and causes significant damage to the burner parts.

New combustor designs for use with syngas or hydrogen rich fuels, such as MBTU, involve redesigning the fuel injector systems to mitigate risks of flash back. The new injector designs take into account the very high reactivity of $H_2$ containing fuels, however the walls of prior art SEV combustors are effusion air cooled and the carrier air convectively cools the lance system. This cooling has proved to be insufficient, leading to durability problems.

Experience has shown that there is an additional need for the SEV combustor to be redesigned to cope with the radically different combustion properties of hydrogen rich fuels such as MBTU, which have lower ignition delay time, higher adiabatic flame temperatures, and higher flame speeds. A higher flow rate of the fuel is also required due to the lower density of hydrogen rich fuels compared to traditional fuels such as natural gas. The application of existing designs to such harsh fuels can result in high emissions and safety issues. To improve the SEV combustor design it has also been suggested to increase dilution of the gas flow or improve the form of the SEV combustor which requires extensive development and validation efforts which are expensive to implement.

SUMMARY

The invention attempts to address these problems. One of numerous aspects of the present invention includes providing an SEV combustor for a sequential combustion gas turbine with an improved design for reducing emissions and/or improving safety.

According to a first aspect of the invention, a method is provided for reducing emissions and/or improving safety in an SEV combustor of a sequential combustion gas turbine whereby an air/fuel mixture is combusted in a first combustor and the hot gases are subsequently introduced into the SEV combustor for further combustion, the SEV combustor having a mixing region for mixing the hot gases with a fuel and a combustion region. According to an exemplary embodiment of the invention, steam is introduced into the mixing region of the SEV combustor.

Introducing steam into the mixing region of the SEV combustor helps in providing enhanced cooling for the lance, increases the resistance to flashback, flame holding, and auto-ignition which contribute to reducing harmful emissions, especially of NOx, and improving safety. The fire-suppressing properties of steam reduces the reactivity of fuels at gas turbine operating conditions, by virtue of the fact that the reactions with steam reduce the concentration of chain carrying radicals in the flame.

In a preferred embodiment of the invention, steam is used to cool the walls of the SEV combustor. The use of steam for cooling provides more effective cooling than with conventional SEV combustors and eliminates the need for carrier air and effusion air-cooling in the SEV mixing region.

In a further preferred embodiment, steam is used to cool a lance which projects into the mixing region for introducing the fuel.

According to a second aspect of the invention, an SEV combustor is provided for a sequential combustion gas turbine whereby an air/fuel mixture is combusted in a first burner and the hot gases are subsequently introduced into the SEV combustor for further combustion, the SEV combustor comprising, a chamber having a chamber wall defining a mixing portion, for mixing the hot gases with a fuel, and a combustion region, at least one inlet for introducing the hot gases into the mixing region, at least one inlet for introducing a fuel into the mixing region and at least one inlet for introducing steam into the mixing region.

The above and other aspects, features, and advantages of the invention will become more apparent from the following description of certain preferred embodiments thereof, when taken in conjunction with the accompanying drawings.

BRIEF DESCRIPTION OF THE DRAWINGS

The present invention is described referring to an embodiment depicted schematically in the drawings, and will be described with reference to the drawings in more details in the following.

The drawings show schematically in.

DETAILED DESCRIPTION OF EXEMPLARY EMBODIMENTS

Figure 2:
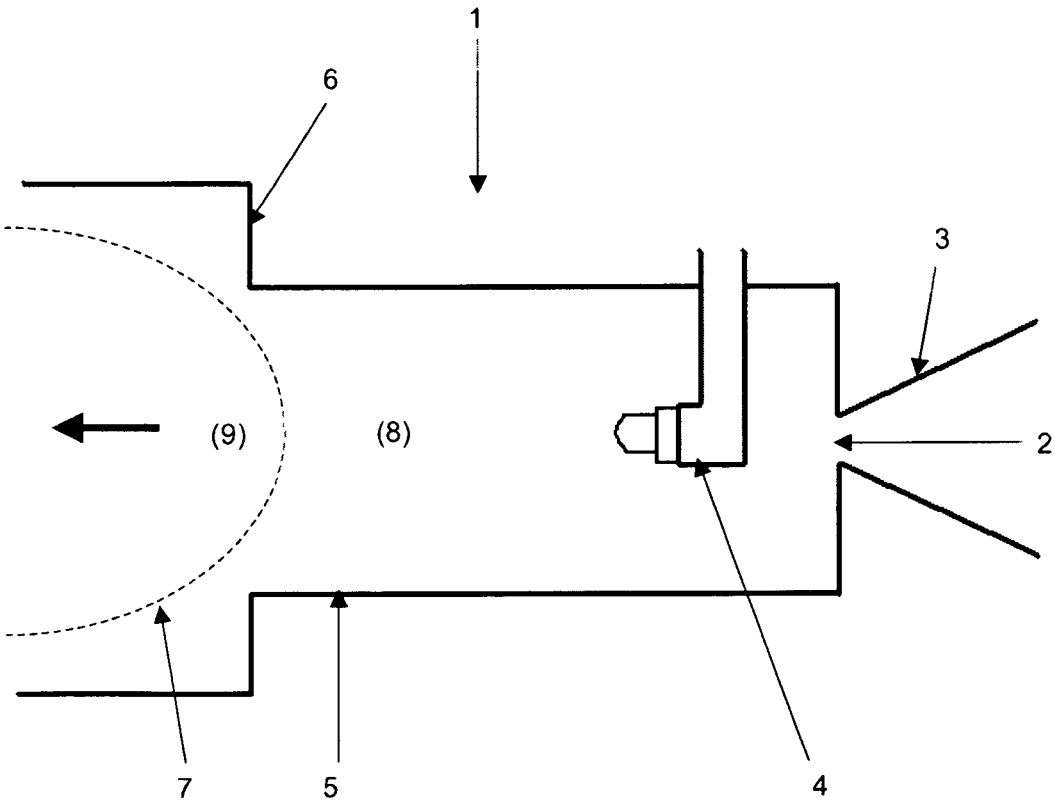
FIG. 2 a prior art SEV combustor.

FIG. 2 schematically shows an SEV (Sequential EnVironmental) combustor 1 according to the state of the art. The SEV combustor 1 forms part of a gas turbine (not shown) with sequential combustion, whereby fuel is combusted in a first combustor and the hot combustion gases 2 are passed through a first turbine and subsequently supplied to a second combustor known as an SEV combustor 1 into which fuel is introduced. The hot combustion gases 2 may be introduced into the SEV combustor 1 through an inlet 3 in the form of a vortex generator or generators. The combustion gases 2 contain enough oxidation gases for further combustion in the SEV combustor 1. The SEV combustor 1 includes a fuel lance 4 for introducing fuel into the combustor 1. The combustor inner space is defined by a combustion chamber wall 5, which has a combustion front panel 6. The combustion front panel 6 is orientated generally perpendicular to the flow of the hot gases through the SEV combustor. The dotted line 7 denotes the border between an upstream mixing region 8 where the fuel injected from the lance 4 mixes with the combustion gases 2 and a downstream combustion region 9. The wall 5 of prior art SEV combustors is effusion air-cooled and the carrier air convectively cools the lance system 4. The prior art SEV combustors have the problem, when using syngas or high $H_2$ content fuel such as MBTU, of insufficient cooling and higher chances of auto ignition (premature ignition) or flash back occurrence, where the combustion boundary 7 moves further upstream leading to increased emissions of NOx and reduced safety. The wall 5 of the combustor 1 has a film layer filled with air and fuel entrained in the central core flow. There is a steep gradient in the fuel concentration from the core towards the wall 5. Existence of such an abrupt variation in the equivalence ratio (lean towards the wall and rich towards the core) will result in higher combustion dynamic amplitudes leading to increased emissions and reduced flashback safety.

Figure 1:
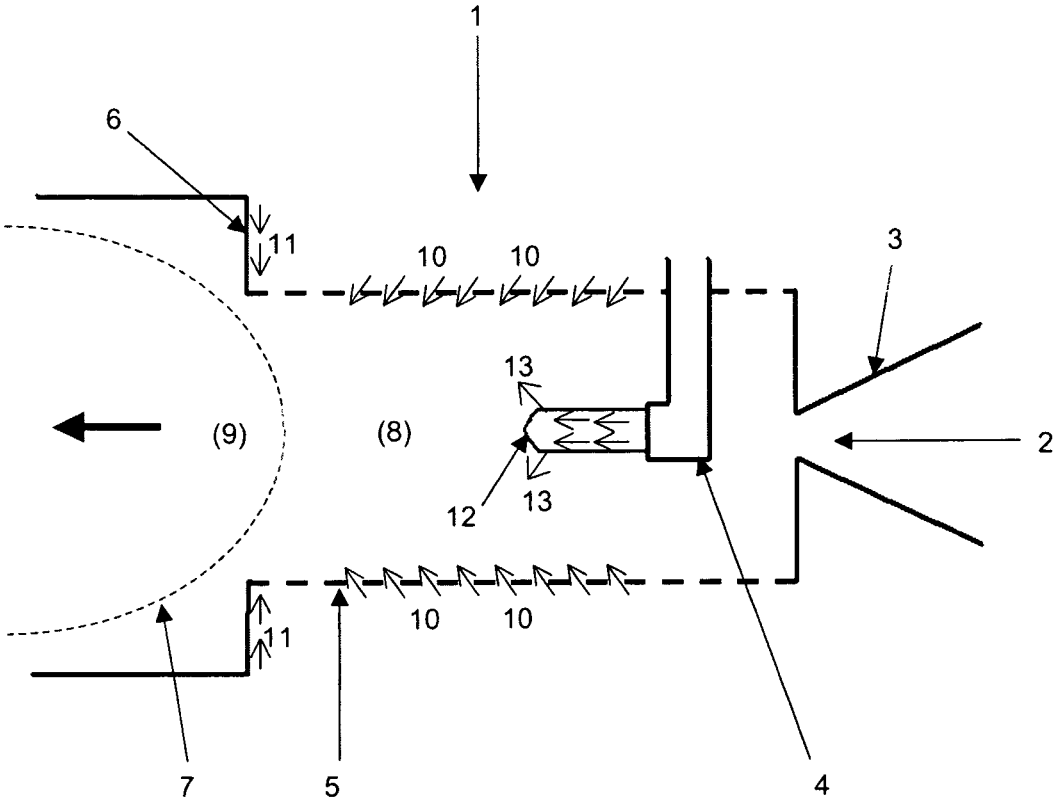
FIG. 1 an SEV combustor according to the invention.

FIG. 1 schematically shows an SEV combustor 1 embodying principles of the present invention. The same reference numerals are used for the same features in FIG. 2. A method for reducing emissions and/or improving safety in an SEV combustor 1 of a sequential combustion gas turbine involves introducing or injecting steam into the mixing region 8 of the combustor. The introduced steam increases the resistance to flashback, flame holding and auto-ignition in the combustor 1, which contribute to reducing harmful emissions, especially of NOx and improving safety. The fire-suppressing properties of steam reduces the reactivity of fuels at gas turbine operating conditions, by virtue of the fact that the reactions with steam reduce the concentration of chain carrying radicals in the flame. Furthermore, the addition of steam has been found to increase extinction strain rates significantly, thereby further deterring flame holding in the mixing region.

The steam is preferably introduced through the wall 5 in the mixing region 8 of the combustor 1, denoted by the arrows 10. Advantageously the steam can be used for effusion cooling of the wall 5 of the combustor 1. For this a plurality of small holes can be provided in the wall 5 of the combustor 1. Due to steam introduction through the combustor wall 5, the aforementioned high fuel combustion dynamics amplitudes can be reduced.

Due to the injection of steam into the mixing region 8 the power output of the combustor is increased and therefore the combustion front panel 6 will get hotter. The steam can also be used to cool the combustor front panel 6. The combustion front panel 6 can be provided with appropriate cooling passages so that the steam can provide convection cooling, denoted by arrows 11. The steam may also be injected into the mixing zone 8 via the combustion front panel 6 for additional cooling of the mixing zone, or the front panel 6 may be effusion cooled with steam.

In a further embodiment of the invention, the steam may be introduced or injected though the lance 4 of the combustor 1. Advantageously, the steam is injected into the gas flow 2 through a steam inlet 13 in the tip of the lance, and preferably from a position upstream of the fuel injector hole(s) 12. The injection of steam into the mixing region 8 from the lance shields the fuel from penetrating to the combustor wall 5 and therefore promotes improved mixing of the fuel with the gas flow 2. The lance 4 can also be provided with appropriate cooling passages so that the steam can be used to cool the lance 4.

Steam cooling helps in providing fuel-air mixing and reduces the flame temperature and consequently the NOx emissions.

The preceding description of the embodiments according to the present invention serves only an illustrative purpose and should not be considered to limit the scope of the invention.

Particularly, in view of the preferred embodiments, different changes and modifications in the form and details can be made without departing from the scope of the invention. Accordingly the disclosure of the current invention should not be limiting. The disclosure of the current invention should instead serve to clarify the scope of the invention which is set forth in the following claims.

LIST OF REFERENCE NUMERALS

1. SEV Combustor
2. Combustion gases
3. Inlet
4. Fuellance
5. Burner wall
6. Combustion front panel
7. Flame Boundary
8. Mixing region
9. Combustion region
10. Arrows
11. Arrows
12. Fuel inlets
13. Steam inlet While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A method for reducing emissions and/or improving safety in a Sequential enVironmental (SEV) combustor of a sequential combustion gas turbine, the SEV combustor having a mixing region for mixing hot gases with a fuel, a combustion region downstream of the mixing region, and a wall between the mixing region and the combustion region with a portion forming a combustion front panel orientated generally perpendicular to the flow of the hot gases through the SEV combustor, the method comprising:

combusting an air/fuel mixture in a first combustor to produce said hot gases;

subsequently introducing the hot gases into the SEV combustor for further combustion;

introducing steam into the mixing region of the SEV combustor; and cooling the combustion front panel with steam.

2. A method according to claim 1, wherein the SEV combustor includes a burner wall, and further comprising:

cooling the burner wall with steam.

3. A method according to claim 1, wherein the SEV combustor includes a lance which projects into the mixing region for introducing the fuel, and further comprising:

cooling the lance with steam.

4. A method according to claim 1, wherein the SEV combustor includes a lance which projects into the mixing region for introducing the fuel, and wherein introducing steam further comprises introducing steam through the lance.

5. A method according to claim 1, wherein the SEV combustor includes a wall, and wherein introducing steam comprising introducing steam through the wall.

6. A method according to claim 1, further comprising, between said combusting and said subsequently introducing:

introducing said hot gases into a gas turbine; and wherein said subsequently introducing comprises introducing said gas gases from said gas turbine.

7. A method according to claim 6, wherein said gas turbine is a first gas turbine, and further comprising, after said cooling:

introducing hot gases from said SEV combustor into a second gas turbine.

8. A method according to claim 1, in which said combustion front panel includes steam cooling passages extending therethrough, said step of cooling the combustion front panel with steam further comprising:

convectively cooling said combustion front panel, including passing said steam through said steam cooling passages in said combustion front panel.

9. A Sequential enVironmental (SEV) combustor useful with a sequential combustion gas turbine, in which sequential combustion gas turbine an air/fuel mixture is combusted in a first burner and the hot gases are subsequently introduced into the SEV combustor for further combustion, the SEV combustor comprising:

a chamber having a chamber wall defining a mixing portion configured and arranged to mix the hot gases with a fuel, and a combustion region downstream of the mixing portion;

at least one inlet configured and arranged to introduce the hot gases into the mixing region;

at least one inlet configured and arranged to introduce a fuel into the mixing region;

at least one inlet configured and arranged to introduce steam into the mixing region;

wherein the chamber wall comprises a portion between the mixing portion and the combustion region orientated generally perpendicular to the flow of the hot gases through the SEV combustor and forms a combustion front panel having a steam cooling passage or holes configured and arranged to cool the combustion front panel with steam; and a steam source in fluid communication with the steam cooling passage or holes.

10. The SEV combustor according to claim 9, wherein at least one of the at least one inlet configured and arranged to introduce steam into the mixing region is positioned in the chamber wall.

11. The SEV combustor according to claim 9, further comprising:

a lance which projects into the mixing region, configured and arranged to introduce fuel into the mixing region;

wherein the at least one inlet for introducing steam into the mixing region is positioned on the lance.

12. The SEV combustor according to claim 9, further comprising:

a lance which projects into the mixing region, configured and arranged to introduce fuel into the mixing region; and a cooling passage formed in the lance configured and arranged to cool the lance with steam.

13. The SEV combustor according to claim 9, further comprising:

a cooling passage in or adjacent to a portion of the chamber wall, the cooling passage configured and arranged to supply steam to cool the chamber wall.

14. The SEV combustor according to claim 9, further comprising:

said hot gases, in the at least one inlet configured and arranged to introduce the hot gases into the mixing region;

said fuel, in the at least one inlet configured and arranged to introduce a fuel into the mixing region; and said steam, in the at least one inlet configured and arranged to introduce steam into the mixing region.

15. A sequential combustion gas turbine comprising:

a first combustor;

a gas turbine fluidly downstream of said first combustor, configured and arranged to receive combustion products from said first combustor to drive said gas turbine; and a second combustor fluidly downstream of said gas turbine, configured and arranged to receive working fluid from said gas turbine, wherein said second combustor is an SEV combustor according to claim 9.

16. A sequential combustion gas turbine according to claim 15, wherein said gas turbine is a first gas turbine, and further comprising:

a second gas turbine fluidly downstream of said second combustor, configured and arranged to receive combustion products from said second combustor to drive said second gas turbine.

* * * * *